US007643784B2

(12) United States Patent
Kondoh et al.

(10) Patent No.: US 7,643,784 B2
(45) Date of Patent: Jan. 5, 2010

(54) FIXING APPARATUS, FIXING MEMBER USED IN THE FIXING APPARATUS, AND IMAGE FORMING APPARATUS HAVING THE FIXING APPARATUS

(75) Inventors: Tsuneaki Kondoh, Ayase (JP); Takayuki Yoshii, Yokohama (JP); Michitaka Higaki, Atsugi (JP); Kohji Kamiya, Yokohama (JP); Eiji Sawamura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 334 days.

(21) Appl. No.: 11/362,799

(22) Filed: Feb. 28, 2006

(65) Prior Publication Data

US 2006/0198666 A1 Sep. 7, 2006

(30) Foreign Application Priority Data

Feb. 28, 2005 (JP) ..... 2005-052337

(51) Int. Cl.
*G03G 15/16* (2006.01)

(52) U.S. Cl. ..... 399/307

(58) Field of Classification Search ..... 399/307, 399/308, 329

See application file for complete search history.

(56) References Cited

U.S. PATENT DOCUMENTS

| | | | | |
|---|---|---|---|---|
| 5,895,152 | A * | 4/1999 | Ide et al. | 399/322 |
| 6,360,073 | B1 * | 3/2002 | Eelen | 399/327 |
| 6,911,240 | B2 | 6/2005 | Kondoh | |
| 2004/0190958 | A1 * | 9/2004 | Matsumoto | 399/329 |
| 2004/0224165 | A1 | 11/2004 | Kondoh et al. | |
| 2005/0095381 | A1 | 5/2005 | Kondoh | |
| 2005/0238373 | A1 * | 10/2005 | Takayanagi | 399/44 |

FOREIGN PATENT DOCUMENTS

| | | | |
|---|---|---|---|
| JP | 62121158 | A * | 6/1987 |
| JP | 10-63121 | | 3/1998 |
| JP | 2001-188421 | | 7/2001 |
| JP | 2002-132075 | | 5/2002 |
| JP | 2002-357966 | | 12/2002 |
| JP | 2004-145260 | | 5/2004 |
| JP | 2004-151626 | | 5/2004 |

OTHER PUBLICATIONS

U.S. Appl. No. 11/613,039, filed Dec. 19, 2006, Aze et al.

* cited by examiner

*Primary Examiner*—David M Gray
*Assistant Examiner*—Erika Villaluna
(74) *Attorney, Agent, or Firm*—Oblon, Spivak, McClelland, Maier & Neustadt, L.L.P.

(57) ABSTRACT

A fixing apparatus including at least one transfer and fixing member which is placed in contact with an image carrier and a recording medium and configured to transfer and fix an image on the image carrier to the recording medium, at least detection mechanism configured to detect a jam generated on the recording medium, a separation mechanism configured to contact the transfer and fixing member with and separate from the transfer and fixing member from the image carrier or recording medium, the separation mechanism being configured to separate the transfer and fixing member from the image carrier or recording medium when the jam on the recording medium is detected by the detection mechanism.

3 Claims, 6 Drawing Sheets

FIXING APPARATUS, FIXING MEMBER USED IN THE FIXING APPARATUS, AND IMAGE FORMING APPARATUS HAVING THE FIXING APPARATUS

CROSS-REFERENCE TO THE RELATED APPLICATION

This application is based on and claims priority benefit from Japanese Patent Application No. 2005-052337, filed on Feb. 28, 2005, the contents of which are incorporated herein by reference.

BACKGROUND OF THE INVENTION

1. Field of the Invention

The present invention relates to a fixing apparatus which is configured to transfer and fix an image on an image carrier to a transfer paper and used in electronics copying machines, laser printers, facsimiles or the like, a fixing member used in the fixing apparatus and an image forming apparatus having the fixing apparatus.

2. Description of Related Art

FIG. 7 illustrates a conventional electro-photographic type-image forming apparatus. The conventional image forming apparatus 220, for example, a copier or laser printer includes an image carrier 201 on which electrostatic latent image is formed, an electrification roller 202 disposed to come in contact with the image cattier 201 and configured to charge it, an exposure mechanism 203 such as laser beam, a development roller 204 to attach toner to the latent image on the image carrier 201, a power pack 205 to apply a DC voltage to the electrification roller 202, a transfer roller 206 to transfer the toner image on the image carrier 201 to a recording medium or transfer paper 207, a cleaning device 208 for cleaning the image carrier 201 after transferring, an electrometer 209 to measure a surface potential of the image carrier 201, and a roller type-heat fixing device 210 including a heat fixing roller 211 and a pressure roller 212.

The electro-photographic type-image forming apparatus 220 is configured to charge a photoconductor layer on the rotating image carrier 201 by the electrification roller 202 uniformly, thereafter, expose the image carrier by the exposure mechanism 203 such as the laser beam and form the electrostatic latent image on the image carrier, form the toner image on the image carrier by developing the electrostatic latent image by the toner, transfer the toner image to the transfer paper 207, and fix the toner image on transfer paper 207 by passing the transfer paper between the fixing roller 211 and the pressure roller 212.

The fixing roller 211 used in the heat fixing device 210 of the image forming apparatus 220 includes a core member formed from a cylinder made of a metal such as aluminum or the like and a surface layer (mold-releasing layer) which is made of fluorine resin and provided on an outer periphery of the core member to prevent the toner from adhering to the core member.

The fixing roller 211 has a heater such as a halogen lamp disposed in the core member along a rotational central axis thereof to heat the fixing roller from inside by radiation heat. By passing the transfer paper 207 between the fixing roller 211 and the pressure roller 212, the toner adhered on the transfer paper 207 is pressed by the fixing roller 211 while softening it by heat from the fixing roller 211 and fixed on the transfer paper.

FIG. 8 illustrates a conventional belt type-fixing apparatus. As shown in FIG. 8, the conventional belt type-fixing apparatus 217 includes a fixing belt 213 movably provided by a heating roller 215 and a fixing roller 214 and a pressure roller 216 disposed to come in contact with the fixing roller 214 through the fixing belt 213.

The belt type-fixing device 217 is configured to pass the transfer paper 207 between the fixing belt 213 heated by the heating roller 215 and the pressure roller 216, press toner adhered on the transfer paper 207 by the pressure roller 216 while softening it by heat of the fixing belt 213 and fix the toner to the transfer paper by pressure of the pressure roller 216.

Here, four colors of red (magenta), blue (cyan), yellow and black are used in a full color copying machine or laser printer. When fixing a color image, because colored toners must be mixed in a melted state, it is necessary to be easy to melt colored toners by making them to low melt point, roll up the plurality of colored toners on a surface of the fixing roller and mix them uniformly in the melted state. Accordingly, a system for heating the colored toners a longer time is required.

Therefore, there has been proposed an apparatus in which a heat source is provided in a drive roller which is an intermediate transfer member and a pressure roller is press-contacted with the intermediate transfer member to form a nip (see, for reference, Japanese Patent Laid-Open H10-63121). The apparatus is configured to fix colored toners heated before the nip to a transfer paper by the nip. In the apparatus, because a secondary transfer from the intermediate transfer member to the transfer paper is achieved by means of fixing of heat, not static electricity, a long heating time for the toners can be set.

However, in the apparatus disclosed in Japanese Patent Laid-Open H10-63121, because the intermediate transfer member is also heated by the same heating time as that of the colored toners, and heated throughout the entire thickness from inside, in the next process, the image carrier is also heated when the intermediate transfer member enters a primary transfer area, accordingly there is a possible that the colored toners are adhered to the image carrier.

To resolve this problem, there has been proposed a fixing apparatus capable of increasing fixing efficiency and image quality and accomplishing miniaturization while preventing an intermediate transfer member from being over-heated by a heating mechanism (see, for reference, Japanese Patent Laid-Open 2004-145260).

In this fixing apparatus, because an image is transferred to a fixing member after the image is transferred from a photo conductor or image carrier to the intermediate transfer member, and finally the image is pressed by a fixing member and a pressure roller and fixed on the transfer paper, a long time to heat toner on the fixing member is required, as a result, it is possible to provide sufficient heat quantity to melt a plurality of colored toners efficiently, accordingly, fix an image having sufficient glaze and less glaze-variation.

In the fixing apparatus, because a low fixing temperature at a nip formed between the fixing member and the pressure roller can be used, it is possible to reduce a starting time and therefore accomplish less energy. In addition, because a nip having a small area is sufficient for a pressing section, it is possible to minimize heat transmission to the transfer paper, therefore to accomplish efficient heating and pressing.

However, in this fixing apparatus, to reduce heat-deterioration of the image carrier, heat transmission from the fixing member having the heating mechanism to the intermediate transfer member contacting with the image carrier, and the pressure roller is required to be limited wherever possible, it is necessary to provide a heat shielding member or heat insulating plate to limit the heat transmission and a cooling roller or the like to draw heat from the intermediate transfer member between a transfer section of the intermediate transfer member and a transfer section from the image carrier.

Furthermore, in this fixing apparatus, when the movement of the transfer paper is stopped by a jam generated when the transfer paper passes the nip formed between the fixing member and the pressure roller, there is a problem that an excessive heat loading is applied to one portion of the fixing member. Because a cooling mechanism provided in the fixing apparatus is designed under heat incoming-loss in a series of fixing cycles, when the feeding of the transfer paper is restarted, or when the transfer paper which remains heated is fed, unexpected heat is transmitted to the fixing member so that the original aim of the fixing member is not achieved, excessive heat is transmitted to the intermediate transfer member, further one portion the excessive heat is transmitted to the image carrier. Consequently, there is a problem that deterioration of the surface of the image carrier is promoted. Moreover, there is a problem that the over heat causes surface-deterioration of the fixing member itself or layer-separation of the fixing member if the fixing member includes a plurality of surface layers.

SUMMARY OF THE INVENTION

An object of the present invention is to provide a fixing apparatus capable of preventing deterioration of a surface layer of a fixing member or the like, separation of the surface layer, adhesion of toner to the surface layer, reduction of transfer property of an intermediate transfer belt, and deterioration of a surface of an image carrier, and having high durability and high reliability, and the fixing member used in the fixing apparatus and an image forming apparatus using the fixing apparatus.

To accomplish the above object, a fixing apparatus according to one embodiment of the present invention includes at least one transfer and fixing member which is placed in contact with an image carrier and a recording medium and configured to transfer and fix an image on the image carrier to the recording medium, at least detection mechanism configured to detect a jam generated on the recording medium, a separation mechanism configured to contact the transfer and fixing member with and separate the transfer and fixing member from the image carrier or recording medium.

The separation mechanism is configured to separate the transfer and fixing member from the image carrier or recording medium when the jam on the recording medium is detected by the detection mechanism.

DETAILED DESCRIPTION OF THE PREFERRED EMBODIMENTS

Preferred embodiments of the present invention will be explained in detail with reference to the accompanying drawings below.

Figure 1A:
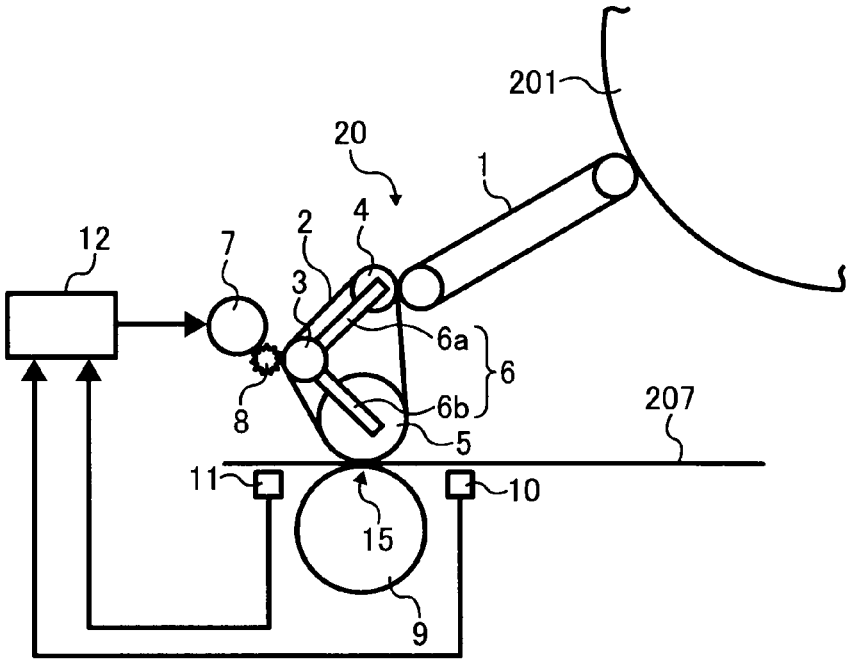
FIG. 1A is a schematic view showing a first embodiment of a fixing apparatus according to the present invention in a steady operation.
Figure 1B:
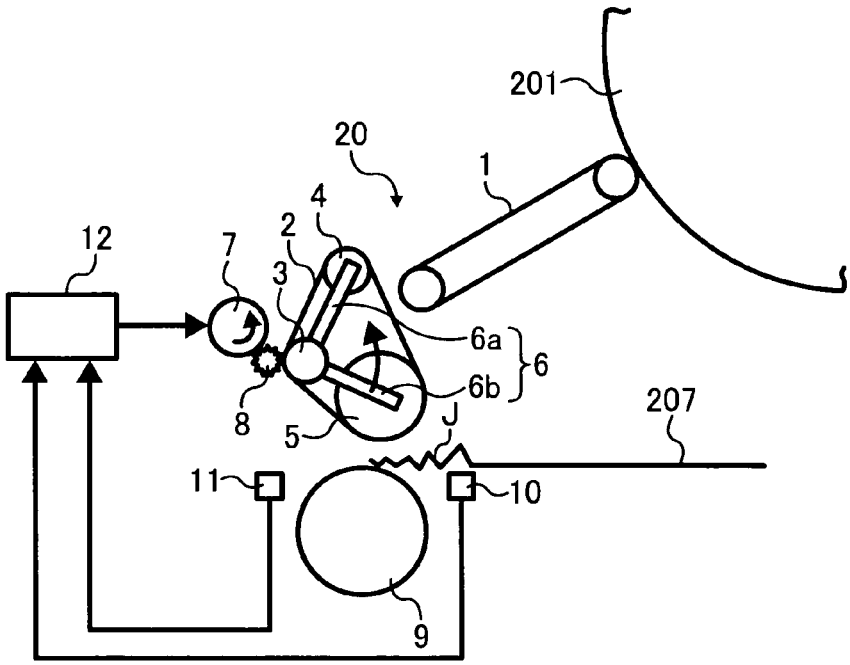
FIG. 1B is a schematic view showing the fixing apparatus as shown in FIG. 1A in an unsteady operation.

FIGS. 1A and 1B illustrate a first embodiment of a fixing apparatus according to the present invention.

The fixing apparatus 20 shown in the first embodiment includes at least one transferring and fixing member which comes in contact with an image carrier 201 and a recording medium or transfer paper 207 and configured to transfer and fix an image on the image carrier to the transfer paper 207.

The transferring and fixing member has an intermediate transfer belt 1 contacting with the image carrier 201 and a fixing belt 2 which comes in contact with the intermediate transfer belt 1 and transfers and fixes an image on the image carrier 201 formed on the intermediate transfer belt 1 to the transfer paper 207.

The fixing belt 2 is wound on a transfer pressure roller 4 and a fixing member, for example, a fixing roller 5. Therefore, the transfer pressure roller 4 is disposed to come in press-contact with the intermediate transfer belt 1 through the fixing belt 2 and the fixing roller 5 is disposed to come in press-contact with the transfer paper 207 through the fixing belt 2 (see FIG. 1A). A pressure member, for example, a pressure roller 9 is disposed to face the fixing roller 5. The pressure roller 9 is configured to form a nip 15 between the pressure roller 9 and the fixing roller 5 by being pressed to the fixing roller 5 through the fixing belt 2 and the transfer paper 207. The recording medium or transfer paper 207 is conveyed passing through the nip 15. The fixing roller 5 is configured to press an image on the fixing belt 2 against the transfer paper 207 passing through the nip 15 and transfers to the transfer paper and fixes the transferred image to the transfer paper.

A detection mechanism to detect a jam J generated on the transfer paper 207 is provided in at least one of an entrance side and an exit side of the nip 15 (see FIG. 1B).

In the first embodiment, detection mechanisms 10 and 11 are provided in both the entrance side and the exit side of the nip 15. Each of the detection mechanisms 10 and 11 is configured to detect the generation of jam J in each of the entrance and exit sides of the nip 15. For example, the detection of the jam J is achieved by continuing the transfer paper 207 by the mechanisms 10 and 11 and detecting whether the transfer paper 207 is smoothly conveyed at a constant speed, for example. Each of the detection mechanisms 10 and 11 is configured to generate a detection signal when detecting the jam J of the transfer paper 207.

A separation mechanism is provided, which is configured to separate the fixing belt 2 from the intermediate transfer belt 1 and transfer paper 207 when the jam J occurs in the transfer paper 207.

The separation mechanism includes a motor 7, an intermediate roller 3 driven by the motor 7 through a gear 8, and an L-character shaped rocking arm 6 attached to the intermediate roller 3. The separation mechanism is mounted on any proper mounting part (not shown).

Meanwhile, the intermediate roller 3 may be connected to the motor 7 directly without using the gear 8.

The rocking arm 6 has a first arm member 6*a* which is fixed at one end thereof to the intermediate roller 3 and a second arm member 6*b* which is fixed at one end thereof to the intermediate roller 3. The transfer pressure roller 4 is rotatably attached to other end of the first arm member 6*a* and the fixing roller 5 is rotatably attached to other end of the second arm member 6*b*.

In the above-mentioned structure, when the motor 7 is rotated counterclockwise as shown in FIG. 1B from a state shown in FIG. 1A, the intermediate roller 3 and the rocking arm 6 through the gear 8 are rotated counterclockwise, and the fixing belt 2 is separated from the intermediate transfer belt 1 and the transfer paper 207, as shown in FIG. 1B.

A control part 12 is connected to the detection mechanisms 10, 11 and the motor 7. The control part 12 rotates, when the jam J of the transfer paper 207 is detected by the detection mechanisms 10 and 11, the motor 7 based on a detection signal of the jam J generated from the detection mechanisms 10 and 11. With the rotation of the motor 7, the fixing belt 2 wound on the transfer pressure roller 4 and the fixing roller 5 which are attached to the rocking arm 6 is separated from the intermediate transfer belt 1 and the transfer paper 207 (pressure roller 6), as shown in FIG. 1B.

In this way, when the jam J occurs in the transfer paper before and after the nip 15 formed between the fixing roller 5 and the pressure roller 6 and the conveyance of the transfer paper is stopped, because the fixing belt 2 is separated from the intermediate pressure belt 1 and the transfer paper 207, it is possible to prevent the deterioration of a surface layer of the fixing belt 2, the layer separation of the fixing belt 2, the attachment of toner to the surface layer of the fixing belt 2, the lowering of transfer property of the intermediate transfer belt 1 for temperature up of the intermediate transfer belt, the deterioration of a surface of the image carrier 201 or the like.

Consequently, it is possible to provide a fixing apparatus having shortened operation-restarting time, durability and reliability, in which a less contacting area of the fixing belt 2 with the other members is accomplished and transmission of heat from the fixing belt 2 to the other members is prevented. In addition, when the jam J occurs at the nip 15, the transfer paper 207 on which the jam occurs can be removed without damaging surfaces of the fixing belt 2 and the pressure roller 9.

In the above-mentioned embodiment, although the pressure roller 9 is used as shown in FIGS. 1A and 1B, instead of the pressure roller a pressure belt may be used.

In the fixing apparatus 20, the control part 12 is configured to detect a state of removal of the jam J of the transfer paper 207 based on a signal detected by one or both of the detection mechanisms 10 and 11 provided in the entrance and exit sides of the nip 15, and based on the detection of removal of the jam J to rotate the motor 7 reversely so that the fixing belt 2 wound on the transfer pressure roller 4 and the fixing roller 5 which are attached to the L-character shaped rocking arm 6 is placed in press-contact with the intermediate transfer belt 1 and the transfer paper 207 at a predetermined pressure. With such a structure, the fixing apparatus 20 can be returned to a steady operation automatically and smoothly.

Figure 2A:
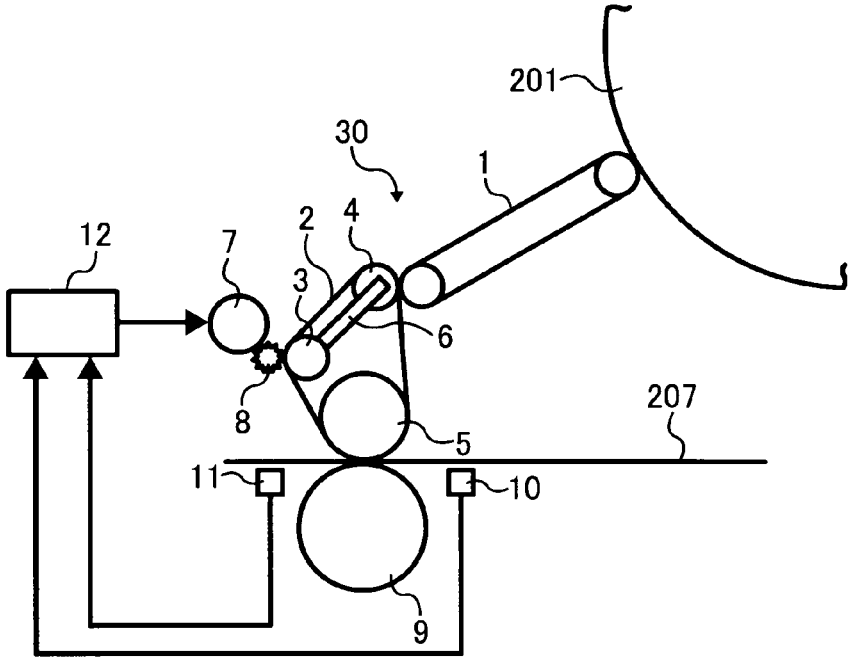
FIG. 2A is a schematic view showing a second embodiment of the fixing apparatus according to the present invention in a steady operation.
Figure 2B:
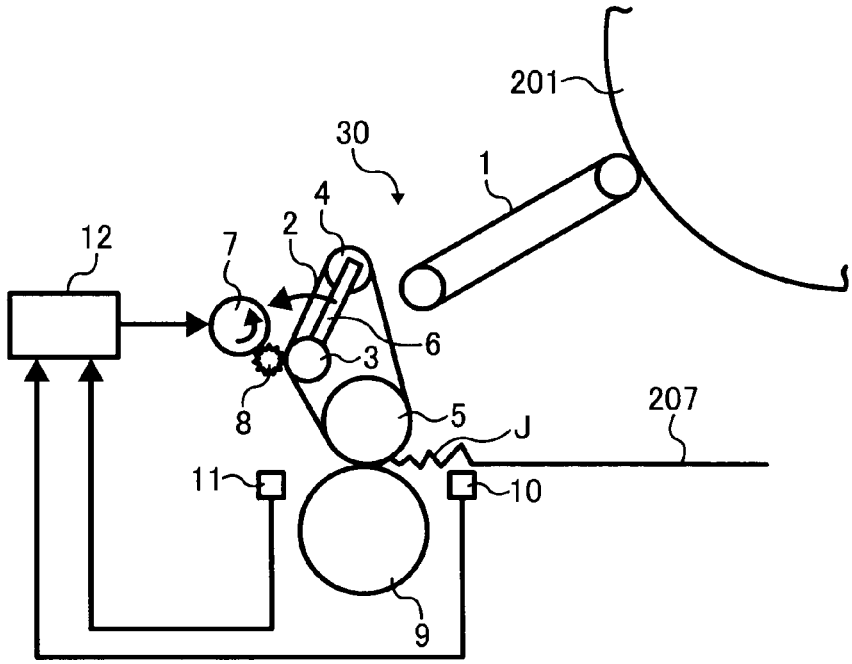
FIG. 2B is a schematic view showing the fixing apparatus as shown in FIG. 2A in an unsteady operation.

FIGS. 2A and 2B illustrate a second embodiment of the fixing apparatus according to the present invention.

The fixing apparatus 30 in the second embodiment differs from the fixing apparatus 20 in the first embodiment in separation mechanism. That is to say, in the separation mechanism in the first embodiment, the fixing belt 2 is configured to be separated from the intermediate transfer belt 1 and the transfer paper 207, whereas the fixing belt 2 is configured to be separated from the intermediate transfer belt 1 in the separation mechanism in the second embodiment.

More specifically, in the separation mechanism, the rocking arm 6 has one arm member 6*c*, and the transfer pressure roller 4 is attached to a leading end portion of the arm member 6*c*, as shown in FIGS. 2A and 2B. Accordingly, when the detection mechanism 10 or 11 detects a jam J of the transfer paper 207 in the operation state as shown in FIG. 2A, the control part 12 rotates the motor 7. The rotation of the motor 7 causes the rocking arm 6 to rock to allow the transfer pressure roller 4 to separate from the intermediate transfer belt 1, whereby separating the fixing belt 2 from the intermediate transfer belt 1 (see FIG. 2B).

In the fixing apparatus 30, the control part 12 is configured to detect the removal of jam J of the transfer paper 207 based on a signal detected by at least one of the detection mechanisms 10 and 11, and rotate the motor 7 reversely based on the detection of the removal of the jam J to allow the fixing belt 2 to come in press-contact with the intermediate transfer belt 1 at a predetermined pressure.

Figure 3A:
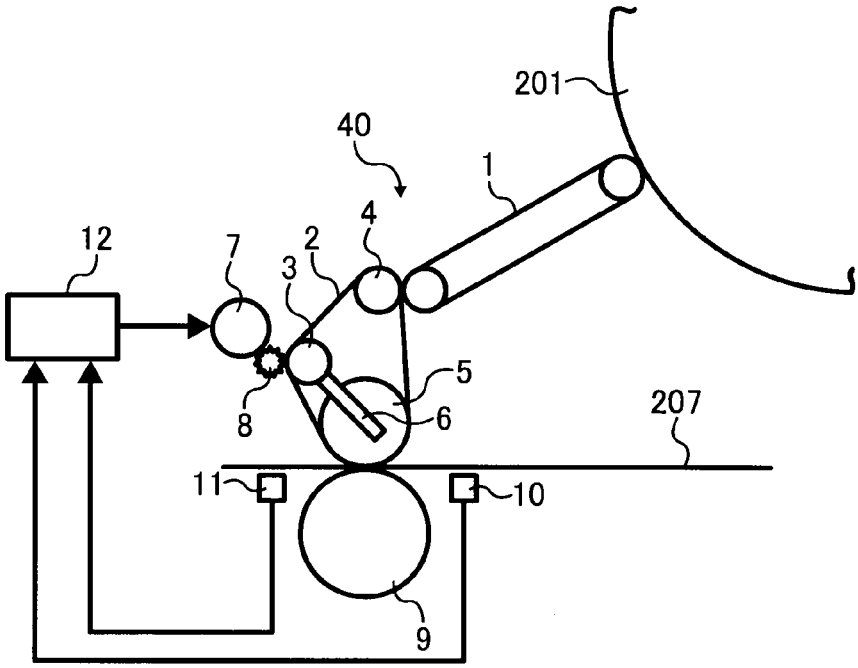
FIG. 3A is a schematic view showing a third embodiment of the fixing apparatus according to the present invention in a steady operation.
Figure 3B:
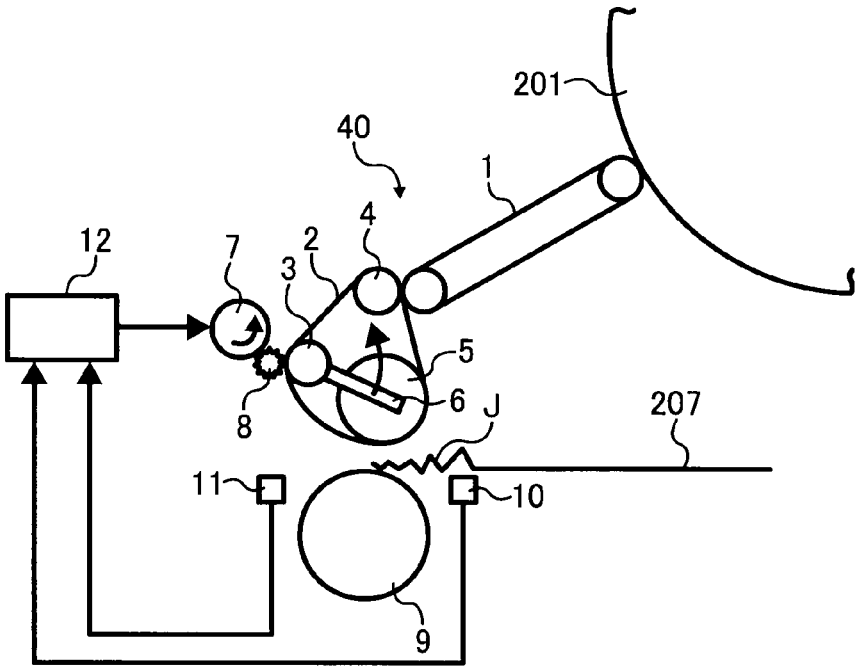
FIG. 3B is a schematic view showing the fixing apparatus as shown in FIG. 3A in an unsteady operation.

FIGS. 3A and 3B illustrate a third embodiment of the fixing apparatus according to the present invention.

The fixing apparatus 40 in the third embodiment differs from the fixing apparatuses 20 and 30 in the above-mentioned first and second embodiments in separation mechanism. That is to say, the fixing belt 2 is configured to be separated from the transfer paper 207 in the separation mechanism in the third embodiment.

More specifically, the separation mechanism in the third embodiment the rocking arm 6 has one arm member 6*d*, and the fixing roller 5 is attached to a leading end portion of the arm member 6*d*, as shown in FIGS. 3A and 3B.

Accordingly, when the detection mechanism 10 or 11 detects a jam J of the transfer paper 207 in the operation state as shown in FIG. 3A, the control part 12 rotates the motor 7. The rotation of the motor 7 causes the rocking arm 6 to rock to allow the fixing roller 5 to separate from the transfer paper 207, whereby separating the fixing belt 2 from the transfer paper 207 (see FIG. 3B).

Also, in the fixing apparatus 40, the control part 12 is configured to detect the removal of jam J of the transfer paper 207 based on a signal detected by at least one of the detection mechanisms 10 and 11, and rotate the motor 7 reversely based on the detection of the removal of the jam J to allow the fixing belt 2 to be in press-contact with the transfer paper 207 and the pressure roller 9 at a predetermined pressure.

In the fixing apparatuses 20, 30 and 40, one or each of the fixing roller 5 and the intermediate roller 3 has a heating source (not shown). In this way, if the heating source is provided in at least one of the fixing roller 5 and the intermediate roller 3, the fixing belt 2 can be heated uniformly.

In the fixing apparatuses 20, 30 and 40, the fixing belt 2 is adapted to drive the pressure roller 3. If the pressure roller 9 drives the fixing belt 2, because a driving radius at a side of the pressure roller 9 is increased by a thickness of the transfer paper 207 when the transfer paper 207 enters the nip 15, the misalignment, distortion or the like of image due to variation of linear speed occurs. If a diameter of the pressure roller 9 is very larger than the thickness of the transfer paper 207, the image misalignment or the like is less, while if the fixing belt 2 drives the pressure roller 9, such a problem does not occur.

In this way, when the fixing belt 2 is driven, the image misalignment or the like can be prevented, and therefore better fixed image can be accomplished.

To prevent the image misalignment or the like by the fixing belt 2 because of the impact when the transfer paper enters the nip 15, it is required that the sum of thicknesses of elastic layers of the fixing belt 2 and the pressure roller 9 is set to be at least larger than the thickness of the transfer paper 207, preferably two times or more. This is based on experimental results in which the inventors in the application have confirmed that if the entire thickness of the elastic layers is two times or more of the thickness of the transfer paper, the misalignment of the transfer paper due to a step difference between the fixing belt and the pressure roller does not occur, and therefore the image misalignment or the like was not visually recognized, in various image forming apparatuses.

The significant recognition of the image alignment or the like by a person is made at 10 cycle/mm (254 dpi, 100 μm pitch) or more in spatial frequency in view of visual MTF characteristic (VTF) (for reference, Base and Application in Electro-photography by Electro-photographic Society, published on Jun. 15, 1988, pages 717 and 718), image misalignment of 100 μm is a great problem. Furthermore, if a high accurate image as a photograph is formed by an image forming apparatus having a high resolving power of 600 dpi in a direction of feeding the transfer paper, each dot interval is 42.3 mm. When the dots vary more than this value, the dots are overlapped, this results in uncomfortable image.

Moreover, the dot intervals are 42.3 μm in 1200 dpi. In this case, the dot overlap is less to be about ⅕ of 254 dpi (100 μm pitch) which is a boundary in the VTF as mentioned above. Therefore, the dot overlap is not recognized visually. Actually, the thickness of the transfer paper mainly used in the electro-photography is a range of 60 to 100 μm, about 30% of the thickness of the elastic layers having a rubber hardness of 5 to 90 is easily and instantaneously compressed. Accordingly, even if an angle θ of a common tangential line of the fixing belt 2 and the intermediate transfer belt 1 to a direction of entering the nip at which the maximum misalignment of the transfer paper occurs is 90°, and if the thickness of the elastic layer is within a range of 120 to 200 μm of about two times of thickness of the transfer paper, it has been recognized that the image misalignment could be reduced to be 24 (=60−120×0.3) to 40 (=100−200×0.3) μm, at least below 42.3 μm. This is represented by the following equation.

Image misalignment=a step difference between the fixing belt and the pressure roller to the thickness of the transfer paper×|sin θ|<42.3 μm (preferable)<100 μm (must)

Where, the equation, the step difference to the thickness of the transfer paper=the thickness of the transfer paper−the entire thickness of the elastic layers×0.3 is satisfied.

Accordingly, in the fixing apparatuses 20, 30 and 40, at least one of the fixing belt 2 and the pressure roller 9 has at least one elastic layer, and the sum of the thickness of the elastic layers of the fixing belt 2 and the pressure roller 9 is set to be two times or more of the thickness of the transfer paper. With such a structure, the image misalignment is prevented, and therefore a high quality image can be acquired.

In the fixing apparatuses 20, 30 and 40, a surface layer of at least one of the fixing belt 2 and the pressure roller 9 is preferably formed by a material which mainly contains fluorine resin. The fluorine resin making the surface layer is tetrafluoroethylene, perfluro alkylvinyl ether copolymer (PFA). In this way, if the surface layer of the at least one of the fixing belt 2 and the pressure roller 9 is made of the material mainly containing the fluorine resin, surface property and mold-releasing property of the surface layer can be prevented from being reduced with a filler contained in the surface layer.

Also, each of paper powder generated by feeding of the transfer paper 207, fixing toner generated by feeding both surfaces copy paper, and toner flying in all directions in the fixing apparatus is prevented from adhering to the surface layer. Consequently, it is possible to ruggedize the fixing apparatuses 20, 30 and 40, thereby enabling to obtain a high quality image.

In the above-mentioned fixing apparatuses 20, 30 and 40, the surface layer contains a conductive material. The conductive material is preferably carbon. An absorbing amount of iodine of the carbon is preferably 43 mg/g or more. In this way, it is possible to increase abrasion resistance and reduce the electrostatic adhesion of the toner flying in all directions in the fixing apparatus to the surface layer by preventing the surface layer from charging, whereby accomplishing the ruggedization of the fixing apparatus and obtaining a high quality image.

Figure 4A:
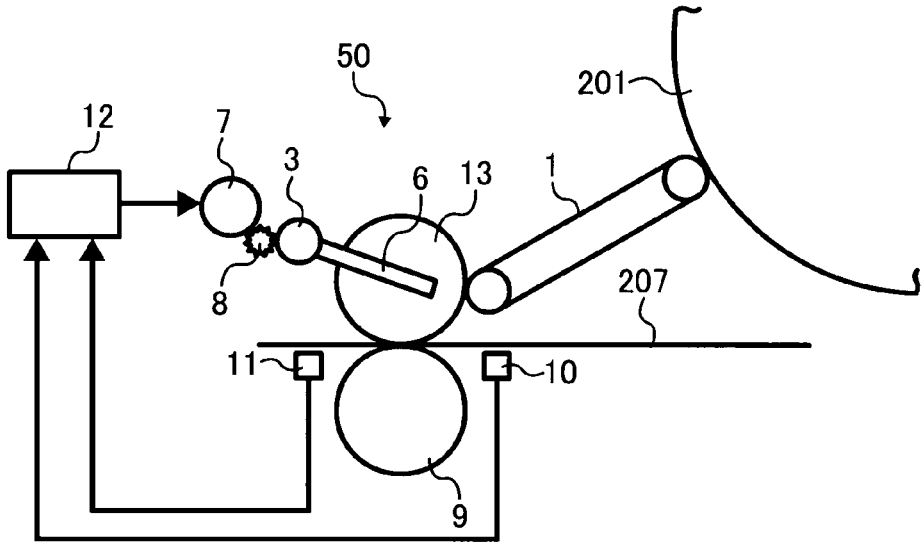
FIG. 4A is a schematic view showing a fourth embodiment of the fixing apparatus according to the present invention in a steady operation.
Figure 4B:
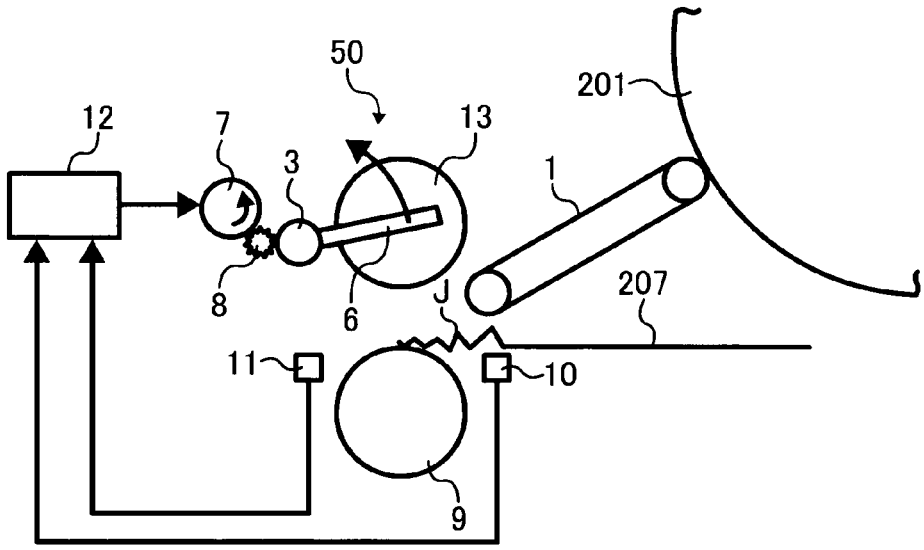
FIG. 4B is a schematic view showing the fixing apparatus as shown in FIG. 4A in an unsteady operation.

FIGS. 4A and 4B illustrate a fourth embodiment of the fixing apparatus according to the present invention.

The fixing apparatus 50 in the fourth embodiment includes an intermediate transfer belt 1 on which an image on an image carrier 201 is transferred, a fixing roller 13 transferring and fixing an image formed on the intermediate transfer belt 1 on a recording medium, or transfer paper 207, and a pressure roller 9 contacting with the fixing roller 13 and forming a nip 15 between the pressure roller 9 and the fixing roller 13. In the fixing apparatus 50, when the transfer paper 207 passes through the nip 15, the image on the transferring and fixing roller 13 is transferred and fixed on the transfer paper 207.

The fixing apparatus 50 differs from the above-mentioned fixing apparatuses 20, 30, and 40 in that instead of the fixing belt 2, the transferring and fixing roller 13 which is disposed to contact with and separate from the intermediate transfer belt 1 and the transfer paper 207 is used. A separation mechanism has a rocking arm 6*e* attached to the intermediate roller 3. The transfer and fixing roller 13 is attached to a leading end portion of the rocking arm 6*e*.

In the fixing apparatus 50, a detection mechanism 10 or 11 detects a jam J (see FIG. 4B) on the transfer paper 207, and a control part 12 controls the transfer and fixing roller 13 to separate from the intermediate transfer belt 1 and the transfer paper 207 when the detection mechanism 10 or 11 detects the jam J on the transfer paper, as shown in FIG. 4B, similarly to the above-mentioned embodiments. Also, the control part 12 is capable of detecting removal of the jam J of the transfer paper 207 based on a signal from the detection mechanism 10 or 11 and rotates reversely a motor 7 based on the remove signal of the jam to allow the transfer and fixing roller 13 to come in press-contact with the intermediate transfer belt 1 and the transfer paper 207 at a predetermined pressure.

In the fixing apparatus 50, the transfer and fixing roller 13 has a heating source (not shown). In this way, if the heating source is provided in the transfer and fixing roller 13, the transfer and fixing roller 13 can be heated uniformly.

In this embodiment, both the transfer and fixing roller 13 and the pressure roller 9 may be driven. In this case, if the thickness of the elastic layer of the pressure roller 9 is zero (0), the maximum image misalignment occurs. The image misalignment is represented by the following equation.

Image misalignment=a linear velocity of the fixing belt×a thickness of the transfer paper/a radius of the pressure roller at the nip×a transfer time=a width of the nip×the thickness of the transfer paper/the radius of the pressure roller at the nip<42.3 μm (preferable)<100 μm (must)

Where, the equation, the nip width=the linear velocity of the fixing belt×the transfer time is satisfied.

In the above-mentioned equation, if the nip width is less than 10 mm and the radius of the pressure roller 9 is 20 mm, the image misalignment is less than 50 μm in the thickness, 100 μm (0.1 mm) of the transfer paper 207. Moreover, if the nip width is less than 5 mm and the radius of the pressure roller 9 is 20 mm, the image misalignment is less than 25 μm in the thickness of 100 μm (0.1 mm) of the transfer paper 207. Accordingly, a less nip width is effective. In addition, more less nip width is preferable for a reason that temperature up of the transfer members such as the intermediate transfer belt 1 depends on the nip width. If the thickness of the transfer paper 207 is about 0.1 mm, to decrease the image misalignment of 600 dpi to be less than 42.3 μm the following equation must be satisfied.

Image misalignment=the nip width/the radius of the pressure roller≦0.423

Accordingly, in the fixing apparatus 50, the pressure roller 9 is driven by the transfer and fixing roller 13. In this way, when the transfer and fixing roller drives the pressure roller 9, the image misalignment can be reduced, thereby obtaining a high quality image.

In the fixing apparatus 50, at least one of the transfer and fixing roller 13 and the pressure roller 9 has at least one elastic layer, and the sum of the thickness of the elastic layers of the transfer and fixing roller 13 and the pressure roller 9 is set to be two times or more of the thickness of the transfer paper 207. With such a structure, the image misalignment is prevented, and therefore a high quality image can be acquired.

Figure 5:
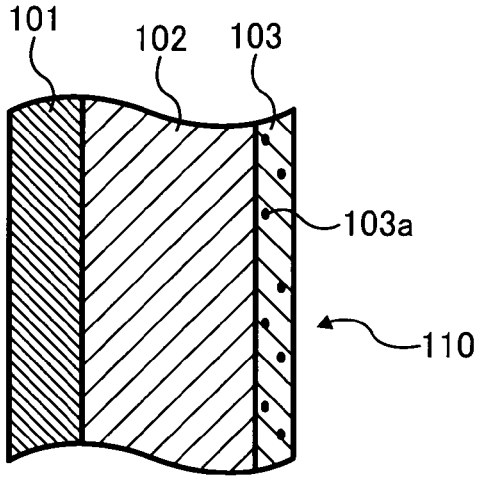
FIG. 5 is a sectional view showing a fixing belt used for the fixing apparatus.

Referring to FIG. 5, one embodiment in which a transfer and fixing member 110 is embodied to a fixing belt is shown.

The fixing belt includes a substrate 101, an elastic layer 102 provided on the substrate 101 and formed by a heat-resisting synthesis rubber, and a surface layer 103 formed by fluorine resin, which are disposed in sequence. A melt point of the fluorine resin forming the surface layer 103 is set to be lower 20° C. or more than an oxidization-starting temperature of the heat-resisting synthesis rubber forming the elastic layer 102. In addition, the surface layer 103 is baked at a temperature which is more than the melt point of the fluorine resin and does not exceed the oxidization-starting temperature of the heat-resisting synthesis rubber forming the elastic layer 102. The heat-resisting synthesis rubber forming the elastic layer 102 mainly contains silicon rubber or fluro-silicon rubber preferably.

Figure 6:
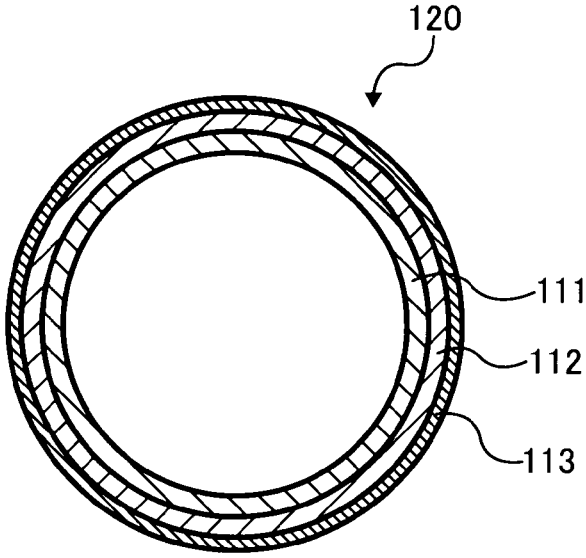
FIG. 6 is a sectional view showing a fixing roller used for the fixing apparatus.
Figure 7:
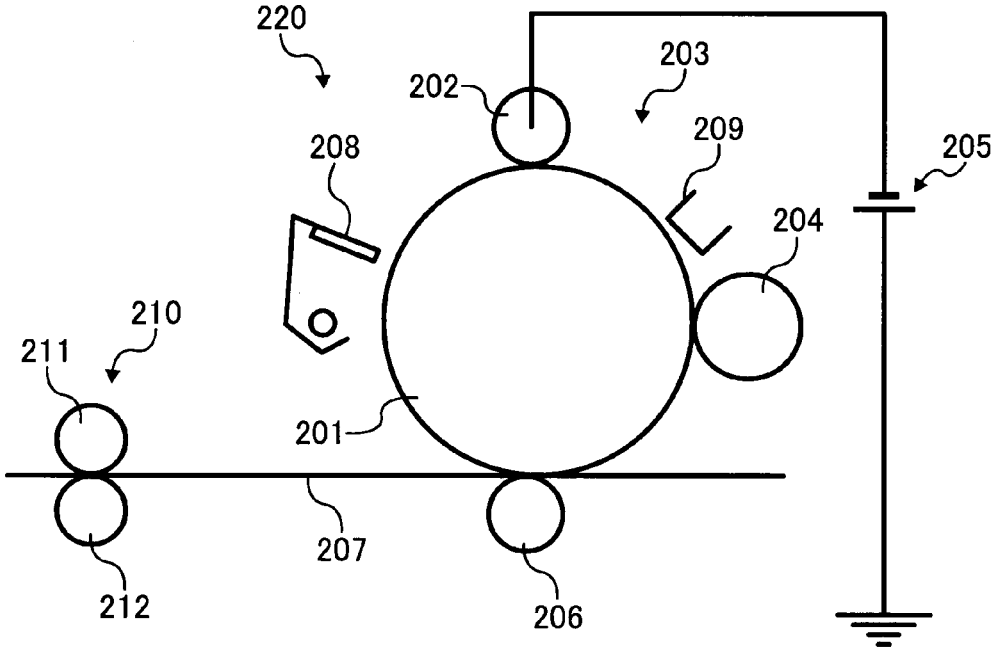
FIG. 7 is a schematic view showing an electro-photographic type-image forming apparatus.
Figure 8:
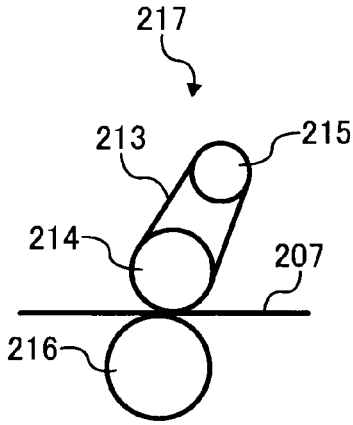
FIG. 8 is an explanatory view showing a conventional belt-type fixing apparatus.

FIG. 6 illustrates another embodiment of the transfer and fixing member, which is embodied as a transfer and fixing roller.

The transfer and fixing roller 120 includes a substrate 111, an elastic layer 112 provided on the substrate 111 and formed by a heat-resisting synthesis rubber, and a surface layer 113 formed by fluorine resin, which are disposed in sequence. A melt point of the fluorine resin forming the surface layer 113 is set to be lower 20° C. or more than an oxidization-starting temperature of the heat-resisting synthesis rubber forming the elastic layer 112. In addition, the surface layer 113 is baked at a temperature which is more than the melt point of the fluorine resin and does not exceed the oxidization-starting temperature of the heat-resisting synthesis rubber forming the elastic layer 112. The heat-resisting synthesis rubber forming the elastic layer 112 mainly contains silicon rubber or fluro-silicon rubber preferably.

With the above-mentioned structure, it is possible to prevent the generation of crack in the elastic layers 102, 112 depending on the deterioration of the heat-resisting rubber forming the elastic layers 102 and 111 and curing of the transfer paper. Moreover, by a conductive material 103*a* contained in each of the surface layers 103 and 113, it is possible to prevent the reduction of surface property and mold-releasing property of each of the surface layers 103 and 113, and each of paper powder generated by feeding of the transfer paper 207, fixing toner generated by feeding both surfaces copy paper, and toner flying in all directions in the fixing apparatus is prevented from adhering to the surface layers 103 and 113. Consequently, it is possible to ruggedize the fixing apparatuses, thereby enabling to obtain a high quality image.

The surface layers 103 and 113 are made of fluorine-system resin such as polytetrafluoroethylene (PTFE), tetrafluoroethylene, perfluro alkylvinylether copolymer (PFA), tetrafluoroethylene/propylene hexafluoride copolymer (FEP), a mixture of these resins, or mixture of the fluorine-system resins and a heat-resisting resin.

The fluorine resin forming the surface layers preferably is tetrafluoroethylene, perfluro alkylvinyl ether copolymer resin (PFA). In this way, if the fluorine resin forming the surface layers 103 and 113 is PFA, a high strength and good flatness of each of the surface layers can be accomplished, and surface property and mold-releasing property of each surface layer can be prevented from lowering.

In addition, each of paper powder generated by feeding of the transfer paper 207, fixing toner generated by feeding both surfaces copy paper, and toner flying in all directions in the fixing apparatus is prevented from adhering to each of the surface layers. Consequently, it is possible to ruggedize the fixing apparatus, thereby obtaining a high quality image.

The surface layers 103 and 113 may be formed by covering resinous tubes on the substrates 101 and 111, respectively, or by spraying an appropriate liquid resin or particulate resin on the substrates and baking it. The conductive material 103*a* contained in the surface layers 103 and 113 is preferably carbon, but may use a material such as metallic powder, silica, mica, boron nitride, inorganic powder covered with other conductive material, or the like. An amount of absorbing iodine by the carbon is preferably more than 43 mg/g.

The conductive material 103 is basically spherical powder, but may use a needle, squama, hollow, or coil shape or the like. Also, one or combination of these shapes may be used. In this way, if each of the surface layers 103 and 113 contains the conductive material, it is possible to increase abrasion resistance of each surface layer, and prevent the surface layers from charging to reduce the electrostatic adhesion of toner flying in all directions in the fixing apparatus to the surface layers.

Consequently, it is possible to accomplish the ruggedization of the fixing apparatus and obtain a high quality image.

The substrates 101 and 111 are made of, for example, a metallic material such as aluminum, iron, stainless steel, brass or the like, but may use a heat-resisting material such as polyimide, polyamide-imide, fluorine resin or the like. If the substrate 101 is made of the metallic material, a thickness of the substrate 101 in the fixing belt 110 is preferably set to be less than 100 μm in view of flexibility of the fixing belt. If the substrate 101 is made of the heat-resisting resin, the thickness of the substrate 101 in the fixing belt 110 is preferably set to be less than 30 to 200 μm in view of heat volume and strength of the fixing belt.

In particular, if a large nip width can be set, there is a case that the elastic layer 102 is not required. Each of the elastic layers 102 and 112 is preferably heat-resisting synthesis rubber such as silicon rubber, fluro-silicon rubber or the like. A thickness of each of the elastic layers 102 and 112 is preferably a range of 100 to 300 μm.

Next, some examples are explained as follows.

Example 1

A fixing belt was formed through the following processes:

(a) forming a first primer layer on a substrate comprising a cylinder made of heat-resisting polyimide resin and having a diameter of 60 mm;

(b) forming an elastic layer having a thickness of 200 μm by applying solution of silicon resin (DY-2083, produced by Toray, Co., Ltd) on the primer layer and vulcanizing it;

(c) forming a second primer layer on the elastic layer; and (d) forming an application layer by applying dispersion liquid of tetrafluoroethylene, perfluro alkylvinyl ether copolymer resin (PFA) (PFA345 HP-J produced by Mitsui DuPont Fluro Chemical Co., Ltd) to which 2 weight percents of a filler made of carbon (#90, produced by Asahi Carbon Co., Ltd) are added, on the second primer layer and drying it, thereafter forming a mold-releasing layer having a thickness of 20 μm by baking the application layer.

Next, a fixing apparatus was prepared by assembling a fixing roller having a halogen heater of 500 W as a heating source disposed at a central portion of the fixing roller, a pressure roller having a diameter of 40 mm in which a surface of an elastic layer is covered with a PFA tube, the fixing belt prepared as mentioned above and attached to the fixing roller and the pressure roller, and a separation mechanism for separating the fixing belt from an intermediate transfer belt and structured similarly to that shown in FIG. 2.

Example 2

A fixing apparatus including the fixing belt prepared as mentioned above and a separation mechanism which separates the fixing belt from the pressure roller and is structured similarly to that shown in FIG. 3 was prepared. Other structure is the same as in the Example 1.

Example 3

A fixing apparatus including the fixing belt prepared as mentioned above and a separation mechanism which separates the fixing belt from the intermediate transfer belt and the pressure roller and is structured similarly to that shown in FIG. 1 was prepared. Other structure is the same as in the Example 1.

Example 4

A fixing apparatus in which 1 weight percent of the filler made of carbon (#90, produced by Asahi Carbon Co., Ltd), instead of 2 weight percents, is added was prepared. Other structure is the same as in the Example 1.

Comparative Example 1

A fixing apparatus in which the separation mechanism for separating the fixing belt from the intermediate transfer belt is not provided was prepared. Other structure is the same as in the Example 1.

Each of the fixing apparatuses prepared in the above-mentioned four examples 1 to 4 and the comparative example 1 was installed in an image forming apparatus and the following points were evaluated.

(1) Heat-deterioration of image carrier (2) Deterioration of pressure roller (3) Operation restarting time, and (4) Offset property The heat-deterioration of the image carrier was ranked as rankings: good; 3, middle; 2, no-good; 1, in view of operating life of the image carrier. The deterioration of the pressure roller was ranked as rankings: good; 3, middle; 2, no-good; 1, in view of scratch and blur of a surface. The operation restarting time was ranked as rankings: good; 3, middle; 2, no-good; 1, in view of a restarting time from operation stop to first copy. The offset property was ranked as rankings: good; 3, middle; 2, no-good; 1, in view of blur of a surface of a fixing image or transfer image.

In the above-mentioned rankings, the rank 2 was determined as success. The evaluating results are shown in the following Table 1.

TABLE 1

| | Heat-deterioration of image carrier | Deterioration of pressure roller | Operation restarting time | Offset property |
|---|---|---|---|---|
| Embodiment 1 | 3 | 2 | 2 | 3 |
| Embodiment 2 | 2 | 3 | 2 | 3 |
| Embodiment 3 | 3 | 3 | 3 | 3 |
| Embodiment 4 | 3 | 3 | 3 | 1 |
| Comparative Example 1 | 1 | 1 | 1 | 1 |

The followings have been known from the Table 1.

1) It is possible to reduce the heat-deterioration of the image carrier and the deterioration of the pressure roller by provision of the separation mechanism.

2) It is possible to reduce the operation restarting time by separating the fixing belt from the intermediate transfer belt and the transfer paper (pressure roller), simultaneously.

3) It is possible to improve durability of the mold-releasing layer to friction, prevent electrostatic offset of the toner to each surface of the transfer member and the pressure roller, eliminate environment problem, and acquire high-quality fixing image.

According to the present invention, because the fixing belt is separated from the image carrier, the intermediate transfer belt contacting with the image carrier, or the transfer paper when the jam occurs on the transfer paper and the transfer paper is stopped, it is possible to prevent the deterioration of a surface layer of the fixing belt 2, the layer separation of the fixing belt 2, the attachment of toner to the surface layer of the fixing belt 2, the lowering of transfer property of the intermediate transfer belt 1 for temperature up of the intermediate transfer belt, the deterioration of a surface of the image carrier 201 or the like.

Although the preferred embodiments have been mentioned, the present invention is not limited to the above-mentioned embodiments, various modifications and changes can be made to these embodiments.

What is claimed is:

1. A fixing apparatus in an image forming apparatus having an image carrier for fixing an image on the image carrier and an intermediate transfer belt contacting the image carrier to transfer the image from the image carrier, the fixing apparatus comprising:

a heated fixing belt supported by a transfer pressure roller and a fixing roller, wherein the transfer pressure roller and the fixing roller are connected such that the fixing belt, the transfer pressure roller and the fixing roller are able to move as a unit between a fixing position in which the transfer pressure roller presses the fixing belt on the intermediate transfer belt to transfer an image from the intermediate transfer belt and the fixing roller forms a nip with a pressure roller to transfer the image fixed by the heat of the fixing belt to a recording medium passing through the nip, and another position in which the fixing belt is separated from the intermediate transfer belt and the fixing roller is separated from the pressure roller;

a detection mechanism positioned to detect a jam of the recording medium at the nip; and a separation mechanism configured to move the unit of the fixing belt, the transfer pressure roller and the fixing roller from the fixing position to the another position, thereby to separate the transfer pressure roller from the fixing belt and the fixing roller from the pressure roller, when a jam is detected by the detection mechanism.

2. The fixing apparatus according to claim 1, wherein the separation mechanism includes a rocking arm configured to support the unit of the fixing belt, the transfer pressure roller and the fixing roller and a motor to drive the rocking arm.

3. The fixing apparatus according to claim 1, wherein the detection mechanism is disposed at each of both sides of the nip.

* * * * *